United States Patent [19]

Hannon et al.

[11] Patent Number: 4,482,298

[45] Date of Patent: Nov. 13, 1984

[54] WEEDLESS PROPELLER

[76] Inventors: R. Douglas Hannon, 991 Eddings Rd.; George E. Lackman, 904 Simms Rd., both of Odessa, Fla. 33556

[21] Appl. No.: 296,329

[22] Filed: Aug. 26, 1981

[51] Int. Cl.[3] ..... B63H 1/20; B63H 1/26

[52] U.S. Cl. ..... 416/234; 416/239; 416/244 B; 416/245 A

[58] Field of Search ..... 416/146 B, 93 A, 242, 416/239, 234, 244 B, 245 A

[56] References Cited

U.S. PATENT DOCUMENTS

| | | | |
|---|---|---|---|
| 22,373 | 12/1858 | Montgomery | 416/245 A UX |
| 1,010,929 | 12/1911 | Loetzer | 416/244 B UX |
| 2,667,936 | 2/1954 | Clark | 416/234 |
| 3,709,634 | 1/1973 | Lorenz | 416/244 A UX |

FOREIGN PATENT DOCUMENTS

| | | | |
|---|---|---|---|
| 1038494 | 8/1966 | United Kingdom | 416/244 B |

*Primary Examiner*—Stephen Marcus
*Assistant Examiner*—Joseph M. Pitko
*Attorney, Agent, or Firm*—Frijouf, Rust & Pyle

[57] ABSTRACT

A weedless propeller comprising a major hub having a plurality of propeller blades. The rearward end of the major hub is bluntly terminated immediately aft the trailing edge of the blades at the root of the blades. A secondary hub is connected to the forward end of the primary hub. The junction between the forward end of the secondary hub and the shroud of the engine or motor driving the propeller is spaced a substantial distance from the major hub and blades. Preferably, the diameter of the primary and secondary hub is the same, with the diameter of the forward end of the secondary hub being substantially equal to the diameter of the shroud of the motor to create a streamline flow of water along the shroud and along the secondary and primary hubs.

10 Claims, 14 Drawing Figures

44
50
52
54
56
58
48

WEEDLESS PROPELLER

BACKGROUND OF THE INVENTION

1. Field of the Invention

This invention relates to propellers; more particularly, this invention relates to propellers characterized as being operable in a weedy environment without becoming entangled therein.

2. Description of the Prior Art

Presently there exists many types of propellers each of which are designed for a particular purpose such as aircraft propulsion, watercraft propulsion and fluid mixing systems. In each instance, the design of the propeller is modified to provide optimal results. For example, in the watercraft industry, it is usually desirable to design the propeller such that the propeller produces a large amount of thrust per unit of power supplied to rotate the propeller. Unfortunately, while there presently exists many high performance propellers, these propellers are unsuitable for use when propelling the watercraft in a weedy environment due to the fact that large amounts of weeds become entangled about the propeller. The propeller then becomes entangled to such a degree that it becomes inoperable to further propel the watercraft thereby necessitating cleaning of the propeller to remove the weeds entangled thereabout. Under the worst operating conditions, it may be necessary to even remove the propeller in order to remove the individual weeds that become entangled about the drive shaft driving the propeller. Obviously, there exists a substantial need for a weedless propeller which is operable in a weedy environment and which is still able to produce a high amount of thrust per unit of energy supplied to the propeller for rotation thereof.

State-of-the-art techniques for producing a weedless propeller have only involved incorporating some type of a cage member forward of the propeller to deflect the weeds from the propeller in an attempt to prevent the weeds from encountering the blades of the propeller. Unfortunately, the weeds tend to accumulate on the forward surface of the cage member. Such accumulation builds up until the entire front surface of the cage member is covered with weeds. Waterflow is therefore substantially prevented from flowing through the cage member to the propeller. With a substantial reduction in the amount of waterflow flowing to the propeller, the thrust produced by the propeller is correspondingly substantially reduced. The cage member must therefore be lifted out of the water and cleaned to remove the accumulated weeds. Thus, it should be appreciated that such cage members merely increase the amount of weeds which may accumulate before cleaning is required. For these reasons, cage type devices have not been widely accepted by consumers.

Therefore, it is an object of this invention to provide an apparatus and method which overcomes the aforementioned inadequacies of the prior art devices and provides an improvement which is a significant contribution to the advancement of the weedless propeller art.

Another object of this invention is to provide a weedless propeller characterized as being operable in a weedy environment without becoming entangled within the weeds thereof.

Another object of this invention is to provide a weedless propeller which overcomes the disadvantages of cage type devices by eliminating other components which may themselves become entangled within the weeds.

Another object of this invention is to provide a weedless propeller which includes an integral design that may be manufactured as a single integral unit.

Another object of this invention is to provide a device which may be retrofitted to an existing propeller of conventional design to transform such propeller into a weedless propeller while maintaining the performance characteristics thereof.

The foregoing has outlined some of the more pertinent objects of the invention. These objects should be construed to be merely illustrative of some of the more prominent features and applications of the intended invention. Many other beneficial results can be attained by applying the disclosed invention in a different manner of modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises a weedless propeller characterized as being operable in a weedy environment without becoming entangled by the individual weeds. In the preferred embodiment, the weedless propeller comprises a major hub portion having a plurality of propeller blades extending radially therefrom. The diameter of the major hub portion is substantial, as compared to conventional propeller design. The rearward end of the major hub portion is bluntly terminated immediately aft of the trailing edge of the blades at the root of the blades. A secondary hub is then connected to the forward end of the primary hub. The length of the secondary hub is substantial, such that the junction between the forward end of the secondary hub and the shroud of the engine or motor driving the propeller is spaced a substantial distance from the major hub and correspondingly, the blades. The diameter of the secondary hub is preferably the same as the diameter of the primary hub. It is noted, however, that the diameter of the forward end of the secondary hub should be substantially equal to the diameter of the shroud of the motor to create a streamline flow of water along the shroud and then along the secondary and primary hubs.

Each of the above features of the propeller of the invention contributes to the weedlessness of the propeller during operation. Thus, it should be appreciated that although elimination of one or more of the above features may decrease the weedlessness of the propeller, the propeller will still remain operable in a weedy environment.

The invention further comprises an individual hub assembly, the component parts of which may be retrofitted to existing propellers of conventional design to modify the flow characteristics of the conventional propeller such that the propeller may be operable in a weedy environment. The hub assembly basically includes two components which are quickly and easily fitted about the hub of the conventional propeller to increase the diameter thereof and to incorporate a secondary hub to the forward end of the hub.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawing.

DETAILED DESCRIPTION

Figure 2:
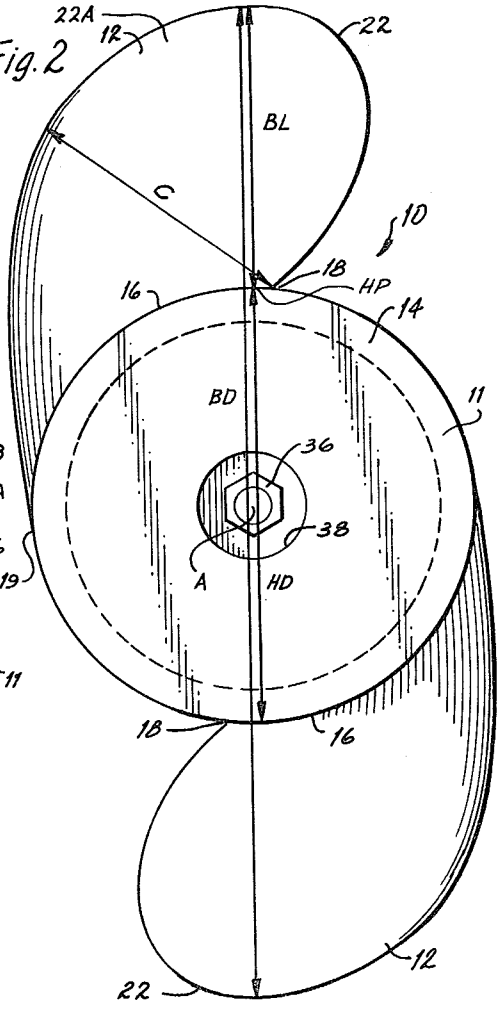
FIG. 2 is a rear view of the propeller shown in FIG. 1.
Figure 1:
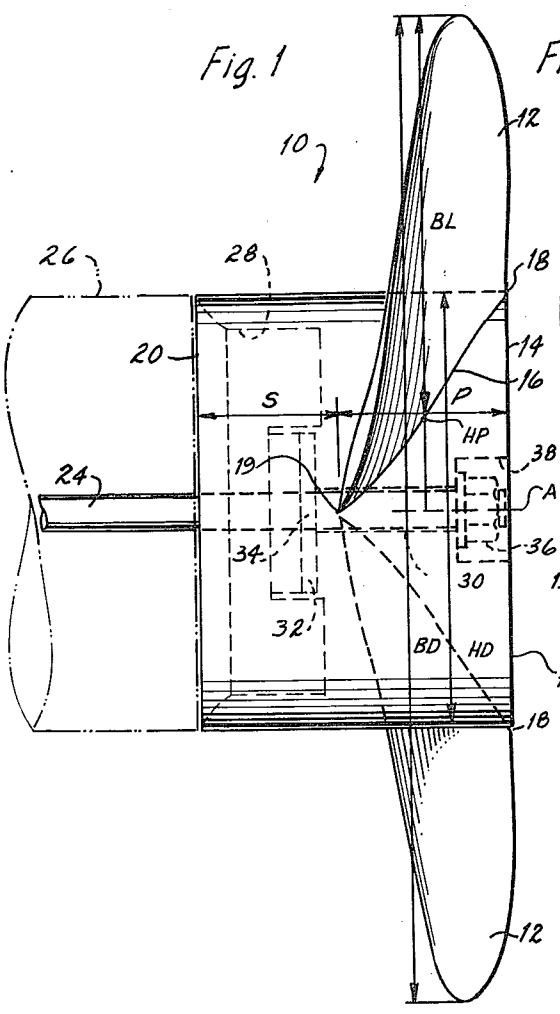
FIG. 1 is a side elevational view of the preferred embodiment of the propeller of the invention.
Figure 3:
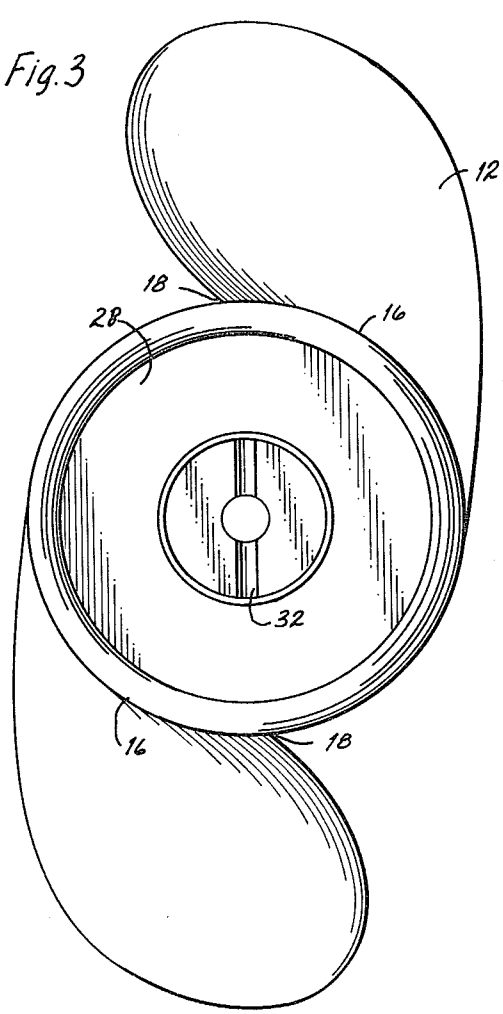
FIG. 3 is a front view of the propeller shown in FIG. 1.
Figure 4:
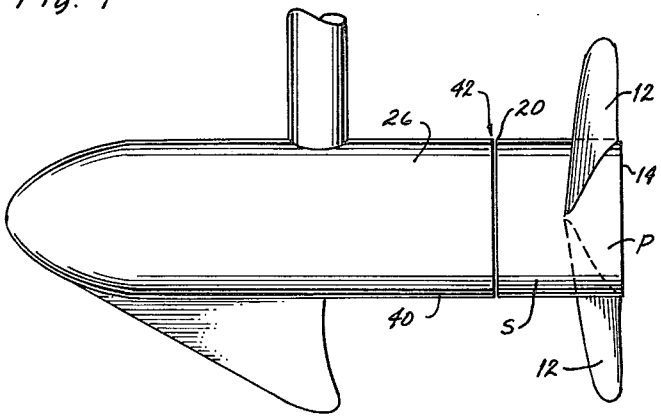
FIG. 4 is a side view showing the propeller of the invention installed on the drive shaft of a drive mechanism.

FIGS. 1, 2 and 3 are a side elevational view, a rear view, and a front view of the preferred embodiment of the propeller 10 of the invention. The propeller 10 comprises a primary hub, denoted by the letter "P", and a secondary hub, denoted by the letter "S", which is connected to the forward end of the primary hub P. The hub includes a hub wall 11 to prevent fluid flow therethrough. The primary hub has an outer surface defined between a leading blade edge 19 and the trailing blade edge 18 with a hub point HP midpoint between the root of the leading and trailing blade edges of the blade 12 which defines a hub diameter HD therebetween. A plurality of propeller blades 12 are integrally molded to and extend radially from the primary hub P. The rearward end 14 of the primary hub P is bluntly terminated at the trailing blade end 18 at the root 16 of the blades 12. The longitudinal length of the secondary hub S is substantial, such that the forward end 20 of the secondary hub S will be positioned a substantial distance from the primary hub P. The blades 12 are designed to produce thrust upon rotation. The blades define a blade length BL extending radially from an axis of rotation A from the hub diameter to a blade diameter BD defined by the rotation of the most distal point of the blades. The hub diameter HD is at least as great as the blade length BL. Each of the plurality of blades is swept back in a direction generally opposite to the normal rotation of the propeller with the majority of the surface area 22A of each of said blades being disposed on one side of a radial line (HD-BL) extending through said hub point HP. Preferably, however, the chord, represented by the distance "C" of each of the blades 12 progressively decreases from the root 16 to the tip 22 of the blade 12. The interior of the propeller 10 of the invention is designed to be connected to the drive shaft 24 of the drive mechanism 26 which rotates the drive shaft 24 (see FIG. 4). In one particular embodiment, the interior of the propeller 10 includes a major cavity 28 positioned concentrically within the secondary hub S. An axial hole 30 is then positioned concentric with the cavity 28 and extends through the remaining length of the secondary hub S and through the entire length of the primary hub P. The axial hole 30 is dimensioned for slidably receiving the drive shaft 24. A recess 32 or keyway is positioned within the bottom of the cavity 28 for receiving the shear pin 34 which extends diametrically through the drive shaft 24. A nut 36 threadably engages the terminal end of the drive shaft 24 for tightly securing the propeller 10 thereto. The nut 36 may be recessed in a counterbore portion 38 of the rearward end 14 of the primary hub P.

The above described embodiment of the propeller 10 works remarkably well in a weedy environment with virtually no weeds becoming tangled about the propeller. Further, the above described propeller produces approximately the same amount of thrust per unit of expended energy as compared to propellers of conventional design. Unfortunately, it was not initially entirely clear why the preferred embodiment of the propeller 10 operated with such astounding results. A substantial amount of experimentation was then conducted to determine the flow patterns of the water as the water flowed into the region of the propeller 10. Further, the results of such experimentation were analyzed by a fluid dynamics expert and several conclusions concerning the operation of the propeller were offered. Those conclusions are discussed hereinafter by referring to FIGS. 5–11. It should be understood that the conclusions discussed hereinafter are not set forth as being totally conclusive explanations of the weedless performance of the propeller.

Figure 6:
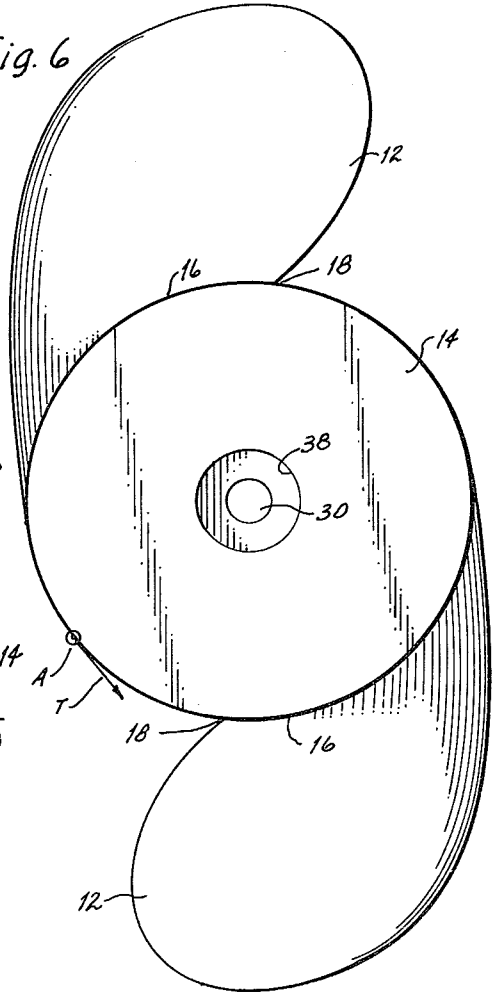
FIG. 6 is a rear view of FIG. 5.
Figure 5:
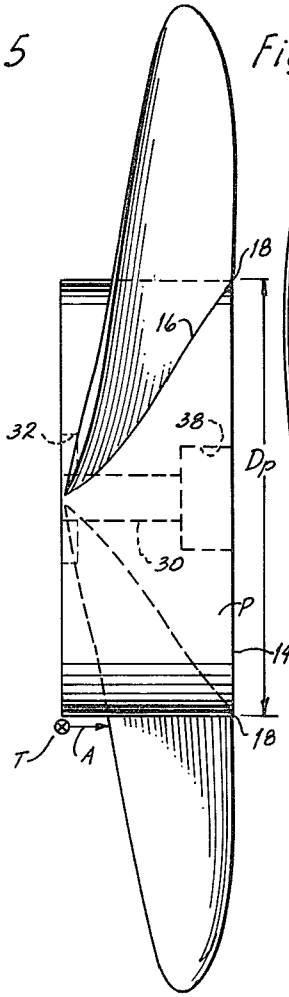
FIG. 5 is a side view of the propeller of the invention illustrating the enlarged primary hub thereof.

Referring to FIGS. 5 and 6, one set of experiments were directed toward producing a propeller 10 having an enlarged primary hub P. It was learned that merely increasing the diameter, represented by the letter "Dp", of the primary hub P produced a propeller 10 which had significant weedlessness characteristics. It was postulated that the enlargement of the primary hub P had the effect of eliminating the least efficient portion of a standard blade by limiting the water flow thereto such that only the more efficient portion of the blade 12 was being used to produce the thrust. Of course, the diameter Dp of the primary hub P must be sufficiently small to expose enough of the blades 12 to enable the rotating blades 12 to produce the desired thrust. The weedlessness effect can be explained in terms of the velocity components of the flow of the water along the longitudinal surface of the primary hub P. It was determined that enlarging the diameter of the primary hub P had the effect of changing the average relative magnitudes of the tangential velocity component, represented by the letter "T", and the axial flow component, represented by the letter "A", such that the axial velocity component A was greater than the tangential velocity component T in the region along the surface of the primary hub P. This should be contrasted to propellers of conventional design wherein the tangential velocity component is greater than the axial velocity component which causes the weeds encountering the conventional propeller to wrap around the hub thereof and therefore become entangled. In striking contrast thereto, the propeller 10 of the invention precludes entanglement of the weed about the primary hub P due to the fact that the axial velocity component A is greater than the tangential velocity component T of the flow of the water along the primary hub P. It is noted that such a change in the magnitudes of the axial and the tangential velocity components A and T substantially reduces the "residence" time in which the weeds are in the proximity of the primary hub P and the propeller blades 12, thereby significantly reducing the possibility that the weeds will become entangled thereabout as the propeller rotates.

Figure 8:
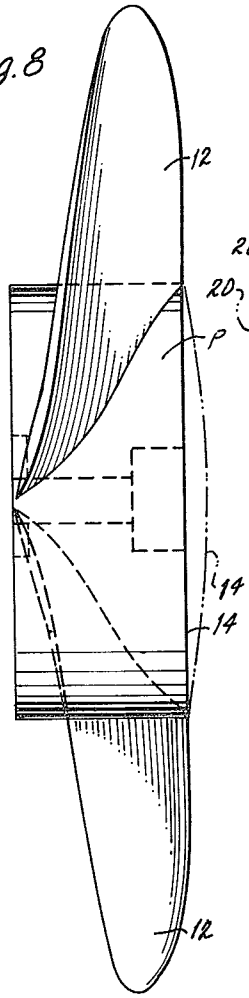
FIG. 8 is still another side view of the propeller shown in FIG. 5 illustrating the dome-shaped configuration of the rearward end of the primary hub.
Figure 7:
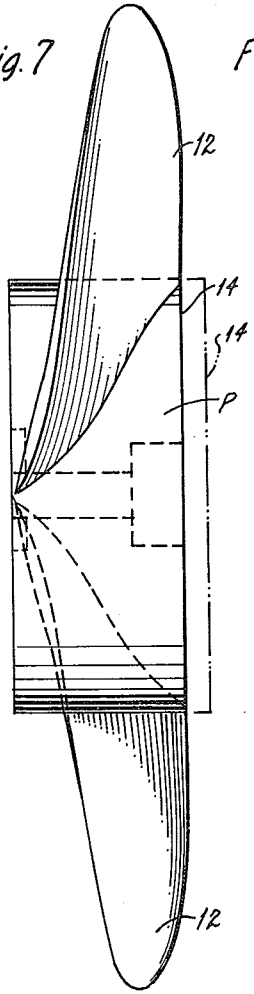
FIG. 7 is another side view of the propeller shown in FIG. 5 illustrating the flat configuration of the rearward end of the primary hub.

As noted earlier, the rearward end 14 of the primary hub P of the propeller 10 of the invention is bluntly terminated. This should be contrasted to conventional propeller design in which a conical shaped afterbody is typically secured aft of the hub to which the blades are connected. It has been proven that the existence of such a streamlined afterbody substantially inhibits the axial flow of the water along the longitudinal surface of the hub and of the afterbody itself. Accordingly, the propeller 10 of the invention lacks any such afterbody. More particularly, the rearward end 14 of the primary hub P comprises a flat configuration which is in line (flush) with the terminal end 18 of the root 16 of the blades 12 such that a large low pressure zone is created behind the rearward end 14 of the primary hub P. It shall be noted that the rearward end 14 of the primary hub P may extend an appreciable distance from the terminal end of the root 16 of the blades 12, as shown in phantom in FIG. 7. However, it should also be noted that by extending the rearward end 14 from the root 16 of the primary hub P, the axial flow of the water along the longitudinal surface of the primary hub P will begin to become inhibited. Thus, the rearward end 14 of the primary hub P should be positioned no more than an appreciable distance from the root 16 of the blade 12. FIG. 8 illustrates a slight modification of FIG. 7, also in phantom, wherein the rearward end 14 of the primary hub P is dome-shaped. The existence of such a dome-shaped configuration should be minimized due to the fact that the dome-shaped configuration reduces the volume of the low pressure zone and, a reduction in the volume of the low pressure zone tends to inhibit the axial flow of the water along the longitudinal surface of the primary hub P.

Figure 9:
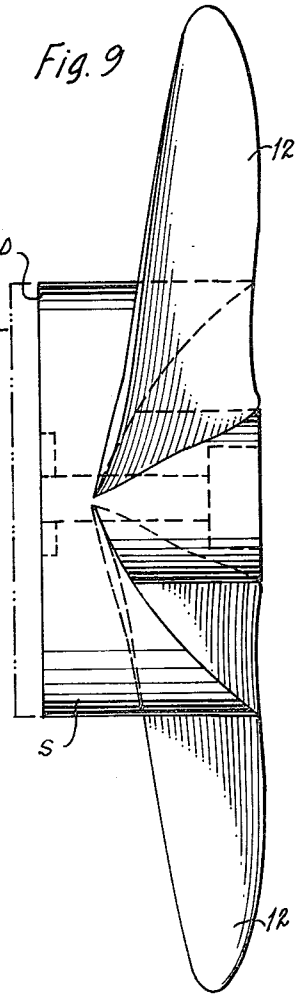
FIG. 9 is a side view of the propeller illustrating the secondary hub which is connected to the forward end of the primary hub.

A third feature of the propeller 10 of the invention includes the incorporation of the secondary hub S to the forward end of the primary hub P. Referring to FIG. 9, the existence of the secondary hub S serves at least two purposes. First, the secondary hub S precludes the radial flow of the water toward the axis of rotation of the primary hub P. This prevents the development of a large tangential velocity component, as compared with the axial velocity component, of the flow of the water in the region of the primary hub P. The weeds are therefore prevented from being drawn into such a region where a large tangential velocity component exists. The secondary hub S further functions to move the junction 42 between the forward end 20 of the secondary hub S and the shroud 40 of the drive mechanism 26 a substantial distance from the primary hub P and correspondingly, from the blades 12. This eliminates the possibility that any weeds which may encounter the blades 12 by virtue of the tangential flow of the water about the primary hub P from being drawn into the junction 42 and wrapping about the drive shaft 24. Accordingly, the length of the secondary hub S should be substantial such that the junction 42 is moved a substantial distance from the primary hub P. Experimentation relating to the length of the secondary hub S has indicated that the longer the length of the secondary hub S, the less likely the weeds will become entangled within the junction 42. Notwithstanding, it is usually only necessary to increase the length of the secondary hub S to a distance as approximately shown in FIG. 9.

Figure 10:
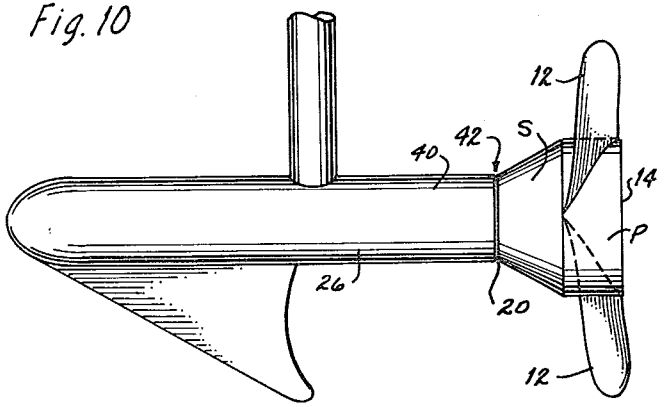
FIG. 10 is a side view of the propeller shown in FIG. 1, illustrating the streamlined configuration of the secondary hub.
Figure 11:
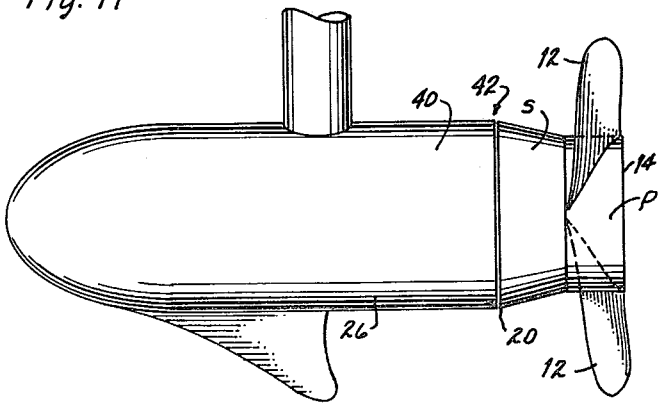
FIG. 11 is another side view of the propeller shown in FIG. 1 illustrating another streamlined configuration of the secondary hub.

As noted earlier, one feature of the propeller 10 of the invention comprises an enlarged secondary hub P. When utilizing the propeller 10 in conjunction with a particular drive mechanism 26, the diameter of the shroud 40 of the drive mechanism 26 may be smaller or larger than the optimal diameter of the primary hub P. As shown in FIGS. 10 and 11, when the diameter of the shroud 40 is smaller or larger, respectively, than the diameter of the primary hub P, the secondary hub S may include a conical shape such that the diameter of the forward end 20 of the secondary hub S will be equal to the diameter of the shroud 40 and such that the diameter of the rearward end of the secondary hub S will be equal to the diameter of the primary hub P.

It should be emphasized that each feature of the invention described above contributes to the overall weedlessness of the propeller 10. In fact, after extensive experimentation, it can be concluded that each feature may be incorporated, to the exclusion of the remaining features, into a propeller of conventional design such that the modified propeller is operable in a weedy environment.

Figures 12, 13, 14:
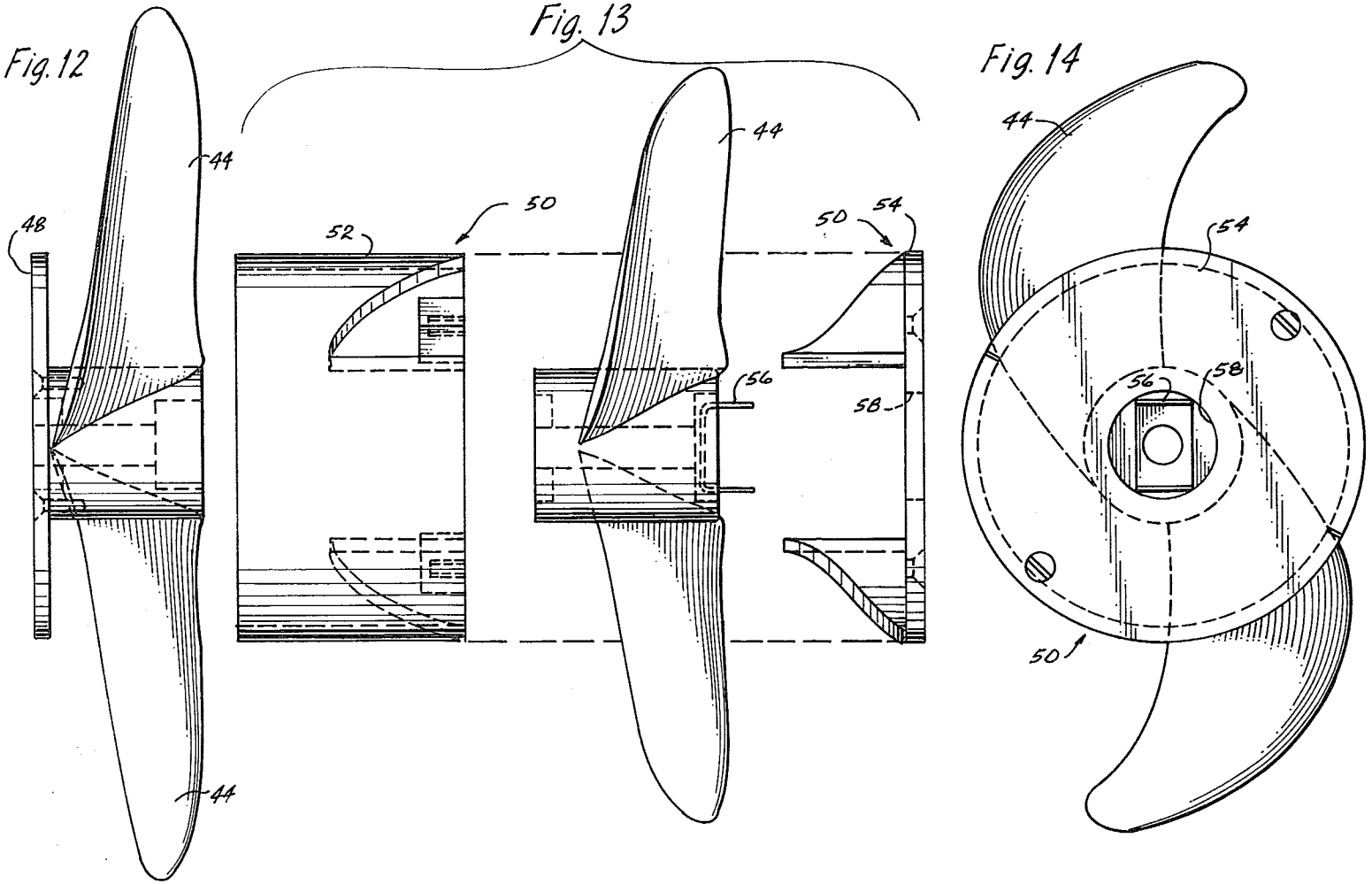
FIG. 12 is another side view of a propeller of conventional design in which a disc is connected to the forward end thereof which changes the flow patterns of the conventional propeller to produce a propeller characterized as being weedless.
FIG. 13 is an exploded side view of a conventional propeller having a device connected thereabout for altering the flow patterns of the conventional propeller to produce a propeller characterized as being weedless.
FIG. 14 is a rear view of FIG. 13.

FIGS. 12–14 illustrate components which may be retrofitted to propellers 44 of conventional design to change the flow patterns of the conventional propellers 44 to produce a propeller characterized as being weedless. More particularly, FIG. 12 illustrates a disc 48 which is connected forwardly to the conventional propeller 44. This disc 48 operates in a manner similar to the secondary hub S by preventing radial flow of the water toward the axis of rotation of the conventional propeller 44. Finally, FIGS. 13 and 14 illustrate a hub assembly 50 which may be incorporated about a conventional propeller 44. The hub assembly 50 includes a first hub member 52 which is positioned about the drive shaft 24 to extend up to the working surface of the propeller blades of the propeller 44. The hub assembly 50 also includes a second hub member 54 which is fitted to the rear of the propeller 44 in mating relationship to the first hub member 52. An alignment spacer 56 is connected within an aperture 58 in second hub member 54 to align the hub assembly 50 to a position concentric with the conventional propeller 44. A nut then threadably engages the terminal end of the drive shaft 24. The hub assembly 50 as thus described and as shown in the drawings may be easily retrofitted to virtually any type of conventional propeller 44 such that the conventional propeller 44 will include all of the features of the invention.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described, we claim:

1. A propeller for producing thrust upon rotation by a rotatable shaft within a fluid medium having a fibrous material therein, comprising:

hub means having an outer surface;

a plurality of blades;

each of said plurality of blades having a blade root, a leading blade edge, a trailing blade edge and a peripheral blade tip;

means connecting said plurality of blades to said hub means with said blade roots adjacent said outer surface of said hub means;

means for connecting said hub means to the rotatable shaft enabling said plurality of blades to produce thrust in the fluid medium upon rotation of said hub means about an axis of said hub means;

said hub means defining a hub diameter upon the rotation of a hub point disposed on said outer surface axially midpoint between said leading blade edge and said trailing blade edge of one of said blades;

said plurality of blades defining a blade length extending radially from said axis of said hub means between said hub diameter and a blade diameter defined by the rotation about said axis of the most distant poiny on said one of said blades;

each of said plurality of blades being swept back in a direction generally opposite to the normal rotation of the propeller with the majority of the surface area of each of said blades being disposed on one side of a radial line extending through said hub point; and means establishing said hub diameter to be at least as great in linear dimension as said blade length of each of said plurality of blades.

2. A propeller for producing thrust upon rotation by a rotatable shaft within a fluid medium having a fibrous material therein, comprising:

hub means having an outer surface, a forward end and a rearward end;

a plurality of blades;

each of said plurality of blades having a blade root, a leading blade edge, a trailing blade edge and a peripheral blade tip;

means connecting said plurality of blades to said hub means with said blade roots adjacent said outer surface of said hub means;

means for connecting said hub means to the rotatable shaft enabling said plurality of blades to produce thrust in the fluid medium upon rotation of said hub means about an axis of said hub means;

said hub means defining a hub diameter upon the rotation of a hub point disposed on said outer surface axially midpoint between said leading blade edge and said trailing blade edge of one of said blades;

said plurality of blades defining a blade length extending radially from said axis of said hub means between said hub diameter and a blade diameter defined by the rotation about said axis of the most distant point on said one of said blades;

each of said plurality of blades being swept back in a direction generally opposite to the normal rotation of the propeller with the majority of the surface area of each of said blades being disposed on one side of a radial line extending through said hub point;

means establishing said hub diameter to be at least as great in linear dimension as said blade length of each of said plurality of blades; and said rearward end of said hub means terminating in a terminating plane in close proximity to a plane defined by the rotation of the most rearward point of said one of said blades.

3. A propeller for producing thrust upon rotation by a rotatable shaft within a fluid medium having a fibrous material therein, comprising:

hub means having an outer surface, a forward end and a rearward end;

wall means for preventing the flow of the fluid medium through said hub means;

a plurality of blades;

each of said plurality of blades having a blade root, a leading blade edge, a trailing blade edge and a peripheral blade tip;

means connecting said plurality of blades to said hub means with said blade roots adjacent said outer surface of said hub means;

means for connecting said hub means to the rotatable shaft enabling said plurality of blades to produce thrust in the fluid medium upon rotation of said hub means about an axis of said hub means;

said hub means defining a hub diameter upon the rotation of a hub point disposed on said outer surface axially midpoint between said leading blade edge and said trailing blade edge of one of said blades;

said plurality of blades defining a blade length extending radially from said axis of said hub means between said hub diameter and a blade diameter defined by the rotation about said axis of the most distant point on said one of said blades;

each of said plurality of blades being swept back in a direction generally opposite to the normal rotation of the propeller with the majority of the surface area of each of said blades being disposed on one side of a radial line extending through said hub point;

means establishing the maximum diameter of said forward end of said hub means to be at least as great in linear dimension as said blade length of each of said plurality of blades; and said rearward end of said hub means terminating in a terminating plane in close proximity to a plane defined by the rotation of the most rearward point of said one of said blades.

4. A propeller for producing thrust upon rotation by a rotatable shaft within a fluid medium having a fibrous material therein, comprising:

hub means having an outer surface, a forward end and a rearward end;

wall means for preventing the flow of the fluid medium through said hub means;

a plurality of blades;

each of said plurality of blades having a blade root, a leading blade edge, a trailing blade edge and a peripheral blade tip;

each of said plurality of blades progressively decreasing from said blade root to said peripheral blade tip;

means connecting said plurality of blades to said hub means with said blade roots adjacent said outer surface of said hub means;

means for connecting said hub means to the rotatable shaft enabling said plurality of blades to produce thrust in the fluid medium upon rotation of said hub means about an axis of said hub means;

said hub means defining a hub diameter upon the rotation of a hub point disposed on said outer surface axially midpoint between said leading blade edge and said trailing blade edge of one of said blades;

said plurality of blades defining a blade length extending radially from said axis of said hub means between said hub diameter and a blade diameter defined by the rotation about said axis of the most distant point on said one of said blades;

each of said plurality of blades being swept back in a direction generally opposite to the normal rotation of the propeller with the majority of the surface area of each of said blades being disposed on one side of a radial line extending through said hub point;

means establishing the maximum diameter of said forward end of said hub means to be at least as great in linear dimension as said blade length of each of said plurality of blades; and said rearward end of said hub means terminating in a terminating plane in close proximity to a plane defined by the rotation of the most rearward point of said one of said blades.

5. A propeller for producing thrust upon rotation by a rotatable shaft within a fluid medium having a fibrous material therein, comprising:

hub means having an outer surface, a forward end and a rearward end;

wall means for preventing the flow of the fluid medium through said hub means;

a plurality of blades;

each of said plurality of blades having a blade root, a leading blade edge, a trailing blade edge and a peripheral blade tip;

means connecting said plurality of blades to said hub means with said blade roots adjacent said outer surface of said hub means;

means for connecting said hub means to the rotatable shaft enabling said plurality of blades to prouce thrust in the fluid medium upon rotation of said hub means about an axis of said hub means;

said hub means including a primary hub adjacent said rearward end and a secondary hub adjacent said forward end;

said primary hub axially extending between said leading blade edge and said trailing blade edge of said plurality of blades;

said secondary hub having an axial dimension which is at least as great as the axial dimension of said primary hub;

said hub means defining a hub diameter upon the rotation of a hub point disposed on said outer surface axially midpoint between said leading blade edge and said trailing blade edge of one of said blades;

said plurality of blades defining a blade length extending radially from said axis of said hub means between said hub diameter and a blade diameter defined by the rotation about said axis of the most distant point on said one of said blades;

each of said plurality of blades being swept back in a direction generally opposite to the normal rotation of the propeller with the majority of the surface area of each of said blades being disposed on one side of a radial line extending through said hub point;

means establishing the diameter of said secondary hub to be at least as great in linear dimension as said blade length of each of said plurality of blades; and said rearward end of said hub means terminating in a terminating plane in close proximity to a plane defined by the rotation of the most rearward point of said one of said blades.

6. A weedless propeller for producing thrust upon rotation by a rotatable shaft within water having weeds, comprising:

a generally cylindrical hub means having an outer surface;

a plurality of blades;

each of said plurality of blades having a blade root, a leading blade edge, a trailing blade edge and a peripheral blade tip;

means connecting said plurality of blades to said hub means with said blade roots adjacent said outer surface of said hub means.

means for connecting said hub means to the rotatable shaft enabling said plurality of blades to produce thrust in the water upon rotation of said hub means about an axis of said hub means;

said hub means defining a hub diameter upon the rotation of a hub point disposed on said outer surface axially midpoint between said leading blade edge and said trailing blade edge of one of said blades;

said plurality of blades defining a blade length extending radially from said axis of said hub means between said hub diameter and a blade diameter defined by the rotation about said axis of the most distant point on said one of said blades;

each of said plurality of blades being swept back in a direction generally opposite to the normal rotation of the propeller with the majority of the surface area of each of said blades being disposed on one side of a radial line extending through said hub point; and means establishing said hub diameter to be at least as great in linear dimension as said blade length of each of said plurality of blades.

7. A weedless propeller for producing thrust upon rotation by a rotatable shaft within water having weeds, comprising:

a generally cylindrical hub means having an outer surface, a forward end and a rearward end;

a plurality of blades;

each of said plurality of blades having a blade root, a leading blade edge, a trailing blade edge and a peripheral blade tip;

means connecting said plurality of blades to said hub means with said blade roots adjacent said outer surface of said hub means;

means for connecting said hub means to the rotatable shaft enabling said plurality of blades to produce thrust in the water upon rotation of said hub means about an axis of said hub means;

said hub means defining a hub diameter upon the rotation of a hub point disposed on said outer surface axially midpoint between said leading blade edge and said trailing blade edge of one of said blades;

said plurality of blades defining a blade length extending radially from said axis of said hub means between said hub diameter and a blade diameter defined by the rotation about said axis of the most distant point on said one of said blades;

each of said plurality of blades being swept back in a direction generally opposite to the normal rotation of the propeller with the majority of the surface area of each of said blades being disposed on one side of a radial line extending through said hub point;

means establishing the maximum diameter of said forward end of said hub means to be at least as great in linear dimension as said blade length of each of said plurality of blades; and said rearward end of said hub means terminating in a terminating plane in close proximity to a plane defined by the rotation of the most rearward point of said one of said blades.

8. A weedless propeller for producing thrust upon rotation by a rotatable shaft within water having weeds, comprising:

a generally cylindrical hub means having an outer surface, a forward end and a rearward end;

wall means for preventing the flow of the water through said hub means;

a plurality of blades;

each of said plurality of blades having a blade root, a leading blade edge, a trailing blade edge and a peripheral blade tip;

means connecting said plurality of blades to said hub means with said blade roots adjacent said outer surface of said hub means;

each of said plurality of blades progressively decreasing from said blade root to said peripheral blade tip;

means for connecting said hub means to the rotatable shaft enabling said plurality of blades to produce thrust in the water upon rotation of said hub means about an axis of said hub means;

said hub means including a primary hub adjacent said rearward end and a secondary hub adjacent said forward end;

said primary hub axially extending between said leading blade edge and said trailing blade edge of said plurality of blades;

said secondary hub having an axial dimension which is at least as great as the axial dimension of said primary hub;

said hub means defining a hub diameter upon the rotation of a hub point disposed on said outer surface axially midpoint between said leading blade edge and said trailing blade edge of one of said blades;

said plurality of blades defining a blade length extending radially from said axis of said hub means between said hub diameter and a blade diameter defined by the rotation about said axis of the most distant point on said one of said blades;

each of said plurality of blades being swept back in a direction generally opposite to the normal rotation of the propeller with the majority of the surface area of each of said blades being disposed on one side of a radial line extending through said hub point;

means establishing the maximum diameter of said forward end of said hub means to be at least as great in linear dimension as said blade length of each of said plurality of blades; and said rearward end of said hub means terminating in a terminating plane in close proximity to a plane defined by the rotation of the most rearward point of said one of said blades.

9. A weedless propeller for producing thrust upon rotation by a rotatable shaft within water having weeds, comprising:

hub means having an outer surface, a forward end and a rearward end;

wall means for preventing the flow of the water through said hub means;

said hub means having only a first and a second blade;

each of said blades having a blade root, a leading blade edge, a trailing blade edge and a peripheral blade tip;

means connecting said blades to said hub means with said blade roots adjacent said outer surface of said hub means;

each of said blades progressively decreasing from said blade root to said peripheral blade tip;

means for connecting said hub means to the rotatable shaft enabling said blades to produce thrust in the water upon rotation of said hub means about an axis of said hub means;

said hub means including a primary hub adjacent said rearward end and a secondary hub adjacent said forward end;

said primary hub axially extending between said leading blade edge and said trailing blade edge of said blades;

said secondary hub having an axial dimension which is at least as great as the axial dimension of said primary hub;

said hub means defining a hub diameter upon the rotation of a hub point disposed on said outer surface axially midpoint between said leading blade edge and said trailing blade edge of one of said blades;

said blades defining a blade length extending radially from said axis of said hub means between said hub diameter and a blade diameter defined by the rotation about said axis of the most distant point on said one of said blades;

each of said plurality of blades being swept back in a direction generally opposite to the normal rotation of the propeller with the majority of the surface area of each of said blades being disposed on one side of a radial line extending through said hub point;

means establishing the maximum diameter of said secondary hub means to be at least as great in linear dimension as said blade length of each of said blades; and said rearward end of said hub means terminating in a terminating plane in close proximity to a plane defined by the rotation of the most rearward point of said one of said blades.

10. A weedless propeller for producing thrust upon rotation by a rotatable shaft within water having weeds, comprising:

a generally cylindrical hub means having an outer surface, a forward end and a rearward end;

wall means for preventing the flow of the water through said hub means;

said hub means having only a first and a second blade;

each of said blades having a blade root, a leading blade edge, a trailing blade edge and a peripheral blade tip;

means connecting said blades to said hub means with said blade roots adjacent said outer surface of said hub means;

each of said blades progressively decreasing from said blade root to said peripheral blade tip;

each of said blades being swept back from said blade root to said peripheral blade tip in a direction generally opposite to the normal rotation of the propeller;

means for connecting said hub means to the rotatable shaft enabling said blades to produce thrust in the water upon rotation of said hub means about an axis of said hub means;

said hub means including a primary hub adjacent said rearward end and a secondary hub adjacent said forward end;

said primary hub axially extending between said leading blade edge and said trailing blade edge of said blades;

said secondary hub having an axial dimension which is at least as great as the axial dimension of said primary hub;

said hub means defining a hub diameter;

said blades having a blade diameter defined by the rotation about said axis of the most distant point on said one of said blades;

said rearward end of said hub means terminating in a terminating plane in close proximity to a plane defined by the rotation of the most rearward point of said one of said blades; and said hub means being of a sufficient hub diameter relative to said blade diameter to provide a weedless propeller.

* * * * *

UNITED STATES PATENT AND TRADEMARK OFFICE

CERTIFICATE OF CORRECTION

PATENT NO. : 4,482,298

DATED : November 13, 1984

INVENTOR(S) : R. Douglas Hannon and George E. Lackman

It is certified that error appears in the above-identified patent and that said Letters Patent are hereby corrected as shown below:

Column 1, line 28, after "Under" delete "the".

Column 7, line 54, delete "poiny" and insert --point--.

Column 9, line 68, delete "prouce" and insert --produce--.

Column 10, line 47, delete "." and insert --;--.

Signed and Sealed this

*Fourteenth* Day of *May 1985*

[SEAL]

*Attest:*

DONALD J. QUIGG

*Attesting Officer* *Acting Commissioner of Patents and Trademarks*